US005593777A

United States Patent [19]

Jacob et al.

[11] Patent Number: 5,593,777

[45] Date of Patent: Jan. 14, 1997

[54] TWO-COMPONENT LOOP YARNS, PRODUCTION THEREOF AND USE THEREOF AS SEWING AND EMBROIDERY YARNS

[75] Inventors: Ingolf Jacob, Untermeitingen; Eberhard Paulus, Bad Hersfeld; Gerhard Kreuzer, Bad Hersfeld; Bernd Schubert, Bad Hersfeld; Josef Geirhos, Bobingen, all of Germany

[73] Assignee: Hoechst Aktiengesellschaft, Germany

[21] Appl. No.: 375,642

[22] Filed: Jan. 20, 1995

[30] Foreign Application Priority Data

Jan. 20, 1994 [DE] Germany ..... 44 01 514.3
Aug. 29, 1994 [DE] Germany ..... 44 30 633.4

[51] Int. Cl.[6] ..... D02G 3/00

[52] U.S. Cl. ..... 428/370; 428/369; 428/399; 57/6; 57/247; 264/211.12

[58] Field of Search ..... 428/370, 375, 428/369, 364, 399; 57/6, 247, 210, 245, 207, 228; 264/211.12, 211.14, 211.17

[56] References Cited

U.S. PATENT DOCUMENTS 4,069,657 1/1978 Bascom et al. .
4,209,559 6/1980 Wada et al. ..... 428/364
5,083,419 1/1992 Greifender et al. ..... 57/6
5,100,729 3/1992 Jacob et al. ..... 428/370
5,102,735 4/1992 Shiojima et al. ..... 428/399
5,146,738 9/1992 Greifender et al. ..... 57/207
5,344,710 9/1994 Jacob et al. ..... 428/370

FOREIGN PATENT DOCUMENTS 0295601 12/1988 European Pat. Off. .
0363798 4/1990 European Pat. Off. .
0367938 5/1990 European Pat. Off. .
0579082 1/1994 European Pat. Off. .
2117659 10/1972 Germany .

*Primary Examiner*—Newton Edwards
*Attorney, Agent, or Firm*—Connolly & Hutz

[57] ABSTRACT

Two-component loop yarns composed of core and effect filaments are made of synthetic polymers and comprise the following features. At least some of the effect filaments are made of polyester, and at least some of the effect filaments have a breaking extension of from 35 to 70%, preferably from 35 to 60%. Moreover, at least some of the effect filaments have a birefringence of from $100*10^{-3}$ to $150*10^{-3}$, in particular from $125*10^{-3}$ to $140*10^{-3}$, and at least some of the effect filaments have a hot air shrinkage of 200° C. of from 3 to 14%, in particular from 5 to 10%. The effect filaments have a filament linear density of not greater than 1.5 dtex.

10 Claims, No Drawings

TWO-COMPONENT LOOP YARNS, PRODUCTION THEREOF AND USE THEREOF AS SEWING AND EMBROIDERY YARNS

BACKGROUND OF THE INVENTION

Two-component loop yarns, production thereof and use thereof as sewing and embroidery yarns The present invention relates to novel two-component loop yarns, to adapted processes for producing them, and to the use of these yarns as sewing and embroidery yarns.

The field of sewing yarns has recently come to include loop yarns composed of core and effect filaments. Loop yarns which are particularly useful as sewing yarns are described for example in EP-A-295,601, EP-A-367,938 and EP-A-363,798.

Prior art loop yarns are produced using a wide range of high-tenacity and textile feed yarns; these are derived for example from low-oriented or partially oriented filaments. Such filaments, if they are to be used as feed yarn component, must customarily be subjected to a drawing process after spinning.

Fully oriented yarns or FOY yarns; cf. Chemiefasern/Textilindustrie, 6/1985, pages 411–2) are also known. These yarns can be used without drawing, saving at least one processing step.

U.S. Pat. No. 4,069,657 discloses the use of highly oriented polyamide yarns for producing air-textured core/effect yarns.

SUMMARY OF THE INVENTION

The use of polyester-based FOY yarns for producing yarns has not been described before. It has now been found that such FOY yarns can be used for producing loop yarns. This makes available for use in loop yarns a class of yarns which are simple and inexpensive to produce.

DETAILED DESCRIPTION OF THE INVENTION

The present invention accordingly provides a two-component loop yarn composed of-core and effect filaments made of synthetic polymers, comprising the following features:

i) at least some of the effect filaments are made of polyester, ii) at least some of the effect filaments have a breaking extension of from 35 to 70%, preferably from 35 to 60%, iii) at least some of the effect filaments have a birefringence of from $100*10^{-3}$ to $150*10^{-3}$, in particular from $125*10^{-3}$ to $140*10^{-3}$, iv) at least some of the effect filaments have a hot air shrinkage at 200° C. of from 3 to 14%, in particular from 5 to 10%, and v) the effect filaments have a filament linear density of not greater than 1.5 dtex.

The FOY effect component to be used according to the present invention is defined by the following combination of features: breaking extension 35 to 60%, birefringence from $100*10^{-3}$ to $150*10^{-3}$, and hot air shrinkage at 200° C. from 6 to 14%. The presentation of such effect components having low filament linear densities in the production of the two-component loop yarn gives a yarn having the above-defined properties.

The breaking extension is measured by the method of DIN 53834 Part 1; the birefringence is measured by the method described in Melliand Textilberichte, 1972, 727–731; and the hot air shrinkage is measured by the method of DIN 53866 Part 3.

The German standard DIN 53834 Part 1 describes a method for obtaining the breaking extension of a yarn. Before the measurement, the sample is fixed between two clips having a distance of 500 mm from each other. Then, the yarn is expanded by a constant speed. The speed is either 50 m/min at a breaking extension of up to 5%, 250 mm/min at a breaking extension up to 40% or 500 mm/min at a breaking extension of above 40%. The breaking extension is obtained by measuring the extension of the yarn at the time when the yarn has broken. Normally, the measured values are average values obtained by testing a plurality of samples (for example 5 units with in each case 20 tests).

The birefringence is measured by using a standard optical microscope using polarized light. For the calculation of the birefringence the "thickness" of the fibers and the difference of the "path difference" has to be measured. Then, the value for the birefringence is obtained by dividing the pathy difference by the fiber thickness. The path difference of the light is obtained when the polarizer and the analyzer or the microscope are in crossed position. Normally, without any sample, no light comes through the crossed polarizers. If a sample is positioned between the polarizer and the analyzer, as a result of the path difference of the light, this is no longer the case. With a compensator, the path difference caused by the sample can be removed. The value for the path difference is read off from the turning wheel of the compensator when the turning wheel is in the position, wherein the path difference is removed.

Testing according to DIN 53866 Part 3 serves to determine the shrinkage characteristics of single and plied yarns by means of treatment in hot air at various selected temperatures. A heat setting apparatus for temperatures up to 300° C. such as a heating oven or heating tube, which allows to heat the sample to the selected temperature and to measure continuously the sample length under the influence of the heat and if necessary to record the heating temperature, with the additional requirements that the deviation of the temperature from the set value must not exceed ±1.5° C. within the immediate vicinity of the sample.

In addition to the effect filaments characterized by the features i) to v), the two-component loop yarn of the present invention may comprise any other desired effect filaments made of synthetic polymers. Preferably the proportion of effect filaments characterized by the features i) to v) is more than 80% by weight, in particular 100% by weight, based on the total amount of the effect filaments.

It was further found that the two-component loop yarns of the present invention are notable for particularly good sewing characteristics and good seam formation, as manifested by a soft hand of the textile sheet materials sewn together; this applies especially when the two-component loop yarns of the present invention comprise a relatively high proportion of effect filaments.

The present invention therefore relates with preference to the above-defined two-component loop yarns having an effect filament proportion of at least 25% by weight, preferably from 30 to 50% by weight, based on the two-component loop yarn.

Core and effect filaments generally differ in their linear density. The core filament linear density can be from 0.5 to 8 dtex. The effect filament linear density can be from 0.2 to 1.5 dtex.

Preference is given to two-component loop yarns having effect and/or core filaments with fine filament linear densities. These embodiments of the yarns according to the present invention, in particular those having fine core and effect filaments, are notable for particularly good sewing characteristics and good seam formation.

The effect filament linear density is preferably from 0.2 to 1.5 dtex, particularly preferably from 0.4 to 1.5 dtex.

The core filament linear density is preferably not greater than 2 dtex, particularly preferably from 0.5 to 2 dtex, and especially from 1 to 2 dtex.

The final linear density of the two-component loop yarns of the present invention is customarily from 100 to 1000 dtex.

Preference is given to two-component loop yarns which have a final linear density of from 100 to 900 dtex.

As mentioned earlier, the two-component loop yarn of the invention is composed of core and effect filaments. The core filaments are on average oriented to a much higher degree in the direction of the fiber axis than the effect filaments, which are intermingled and intertwined with the core filaments but which in addition, owing to their greater length, form loops which protrude from the fiber assembly and hence play a significant part in determining the textile properties and the end-use/in-service properties, such as the serving characteristics, of the yarn according to the invention.

The total linear densities of the core and effect filaments of the loop yarn of the invention are customarily in a ratio of from 40:60 to 75:25, preferably from 55:45 to 70:30.

The core component of the two-component loop yarn of the present invention can comprise any desired high tenacity filament made of synthetic polymers. The tenacity of the core component of the two-component loop yarn is usually more than 30 cN/tex, for example from 30 to 80 cN/tex. Preference is given to core filaments having a tenacity of from about 40 to about 75 cN/tex.

The loop yarn of the present invention usually has a final tenacity of more than 30 cN/tex, preferably of more than 40 cN/tex. The final tenacity is the ratio of breaking strength and final linear density at the moment of rupture. The final tenacity of the loop yarns of the present invention is particularly preferably from 45 to 60 cN/tex.

The loop yarn of the present invention preferably has a hot air shrinkage at 200° C. of below 8%, in particular below 6%.

Very particular preference is given to two-component loop yarns which have a final tenacity of more than 40 cN/tex and a hot air shrinkage at 200° C. of below 6%.

In principle, the core component and part of the effect component of the two-component loop yarns of the present invention can be produced from any synthetic spinnable addition polymers and polycondensation products, for example polyamides, such as nylon types or aramids; polyacrylonitrile; polyolefins, such as polyethylene or polypropylene; polyether ketones, such as PEK or PEEK; polyarylene sulfides, such as poly-para-phenylene sulfide; and polyesters, such as polyethylene terephthalate.

Particular preference is given to using polyester as the starting material for the yarns of the present invention, in particular as the starting material for both the yarn components.

Suitable polyesters are in particular those which are obtained essentially from aromatic dicarboxylic acids, for example 1,4-, 1,5- or 2,6-naphthalenedicarboxylic acid, isophthalic acid or in particular terephthalic acid, and aliphatic diols of from 2 to 6, in particular from 2 to 4, carbon atoms, e.g. ethylene glycol, 1,3-propanediol or 1,4-butanediol, by cocondensation. It is also possible to use hydroxycarboxylic acids, e.g. p-(2-hydroxyethyl)benzoic acid, as starting materials for polyesters.

The abovementioned polyester raw materials may be modified by incorporation as cocondensed units of small amounts of aliphatic dicarboxylic acids, e.g. glutaric acid, adipic acid or sebacic acid, or of polyglycols, e.g. diethylene glycol (2,2'-dihydroxydiethyl ether), triethylene glycol (1,2-di(2-hydroxyethoxy)ethane) or else of minor amounts of higher polyethylene glycols.

Another option, which affects in particular the dyeing characteristics of the two-component loop yarns of the invention, is to incorporate sulfo-containing units, for example sulfoisophthalic acid units.

It is also possible to make the loop yarns of the invention from low-flammable polyester materials, preferably from phospholane-modified polyethylene terephthalate. Examples of this modified polyester are recited in DE-C-2, 346,787.

The upper limit for the final tenacity of the loop yarns of the invention depends on the degree of condensation chosen for the polymer, in particular polyester, used. The degree of condensation of the polymer is reflected in its viscosity. A high degree of condensation, i.e. a high viscosity, leads to particularly high final tenacities.

Polyester loop yarns having a high final tenacity are obtainable using in particular high molecular weight polyesters having an intrinsic viscosity (measured in solutions in dichloroacetic acid at 25° C.) of not less than 0.65 dl/g, in particular from 0.7 to 0.85 dl/g. This applies at least to the core component, possibly however to both the core and the effect component.

A preferred polyester material for producing the loop yarns of the invention is polyethylene terephthalate. This is to be understood as including a copolyester containing recurring ethylene terephthalate units.

The two-component loop yarn of the invention, which is composed of core and effect filaments, is produced by jet texturing two or more feed yarn strands introduced into the jet at different rates of overfeed. The texturing medium used is a fluid, for example water or in particular a gas which is inert towards the feed yarn strands, in particular air, with or without moistening or with a previously moistened feed yarn.

The invention further provides a process for producing a two-component loop yarn composed of core and effect filaments made of synthetic polymers, comprising the measures of:

a) feeding two or mote feed yarn strands made of synthetic polymers at different speeds into a texturing jet, at least one of said feed yarn strands being made of polyester filaments whose breaking extension is from 35 to 60%, whose birefringence is from $100*10^{-3}$ to $150*10^{-3}$, in particular from $125*10^{-3}$ to $140*10^{-3}$, and whose hot air shrinkage at 200° C. is from 6 to 14%, in particular from 8 to 10%, b) intermingling the feed yarn strands in the texturing jet under conditions to form a yarn consisting of core and effect filaments and having loops formed chiefly of effect filaments on its surface, c) withdrawing this primary two-component loop yarn under tension so that, through reduction in the loop size, said primary yarn becomes mechanically stabilized, d) heating the stabilized primary yarn to set the yarn structure, and preferably c) choosing the strand linear densities of the feed yarn strands, the difference in the transport speeds of the feed yarn strands and the intermingling, mechanical stabilization and setting conditions in such a way as to produce a two-component loop yarn whose proportion of effect filaments is at least by weight, preferably more than 30% by weight.

Jet texturing of yarn comprises, as will be known, feeding the filament material into the texturing jet at a higher speed than that at which it is withdrawn therefrom. The excess of the feed speed over the withdrawal speed, expressed as a percent of the withdrawal speed, is termed the overfeed. In the process of the invention, then, the yarn strands which are to be mixed with each other, and which in the finished yarn then supply the core or the effect filaments, are fed into the texturing jet different rates of overfeed. The feed yarn strand which will constitute the core filaments of the yarn according to the invention will usually be fed into the texturing jet at an overfeed of from 3 to 10%, while the feed yarn strand which will constitute the effect filaments of the yarn according to the invention will usually be overfed at from 10 to 60%.

Owing to this difference in the rate of overfeed, longer lengths of the effect filaments are intermingled in the texturing jet with shorter lengths of the core filaments, the result being that, in the ready-produced yarn of the invention, the effect filaments form appreciably more arcs and loops than the core filaments, which extend essentially in the direction of the yarn axis. The different overfeeds further make it possible to control the final linear density of the loop yarn. The final linear density $T_S$ of the intermingled yarn is not simply the sum of the linear densities of the feed yarns; the overfeed of the two feed yarns has to be taken into account. The final linear density $T_S$ of the intermingled yarn is accordingly given by the following formula:

$$T_S=T_{SI}*(1(V_{SI}/100))+T_E*(1(V_E/100))$$

where $T_{SI}$ and $V_{SI}$ are the linear density and overfeed of the core feed yarn and $T_E$ and $V_E$ are the linear density and overfeed of the effect feed yarn.

It is customary to use feed yarn strands having different strand and filament linear densities, at least the feed yarn for the core filament consisting of filaments having a tenacity such that the loop yarn final tenacity desired for the field of use in question can be achieved.

Feed yarns for the purposes of the present invention are yarns which are prior to entry into the intermingling jet and are used as core and effect components for forming the loop yarn.

In the feed yarns for producing the two-component loop yarns of the present invention the core component is preferably a high tenacity multifilament yarn, whereas the effect component is at least in part an FOY multi-filament yarn.

Suitable starting material for producing the core component is any desired multifilament yarn which either has already been presented to the texturing apparatus as a high tenacity multifilament yarn or is drawn directly before entry into the texturing jet. Suitable starting material for producing the high tenacity multifilament yarns is for example any low orientation yarn (LOY), partially oriented yarn (POY) or highly oriented yarn (HOY) made of polyester. The starting materials can acquire the requisite high tenacity by appropriate drawing (cf. Treptow in Chemiefasern/Textilindustrie 6/1985, p.411 ff).

Preferred polyesters for producing these high tenacity multifilament yarns have in particular intrinsic viscosities (measured as indicated above) within the range from 0.60 to 0.70 dl/g or—in the case of particularly high molecular weight types for producing the core feed yarns—within the range from 0.70 to 0.85 dl/g.

The core feed yarns for producing the two-component loop yarns of the present invention are preferably high strength and, low shrinkage yarns as described for example in DE-B-1,288,734 or EP-A-173,200.

DE-B-1,288,734 describes a process for the production of low oriented high tenacity polyester yarns. EP-A-173,200 describes sewing yarns and a process for the production of such sewing yarns by the use of high oriented yarns.

Further preferred core feed yarns have a hot air shrinkage at 180° C. of not more than 9%, generally from 4 to 9%, preferably from 5 to 8%.

Further preferred core feed yarns have a breaking extension of not more than 15%, generally from 8 to 15%, preferably from 8.5 to 12%.

The effect feed yarns used are, as described above, conventional FOY multifilament yarns. Preferred polyesters for producing these high tenacity multifilament yarns for producing the effect feed yarns have in particular intrinsic viscosities (measured as indicated above) within the range from 0.60 to 0.70 dl/g. The process of the present invention can also be carried out with effect filaments having filament linear density above 1.5 dtex. Usually the effect yarns used are obtained from effect filaments having a filament linear density of not more than 4.5 dtex. Preference is given to the above-indicated preferred ranges for the filament linear densities of the effect filaments.

Such FOY multifilament yarns are preferably produced as described in DE-A-2,117,659.

The present invention preferably relates to a process for producing two-component loop yarns composed of core and effect filaments as described above wherein the feed yarn strand used for the effect component is an FOY yarn obtained by spinning at take-off speeds above 2000 m/min, the following process steps having been employed:

f) melt spinning multifilaments in a conventional spinning apparatus with a heating element between the spinning jets and the take-off element, g) cooling the spun multifilaments upstream of the heating element to the solidification temperature or below, and h) subsequently heating the multifilaments to temperature above the solidification point under the simultaneous action of the thread tension resulting from the friction against the surrounding gaseous medium, which thread tension must be equal to the necessary drawing tension.

If high-strength low-shrinkage two-component loop yarns are to be produced, the feed yarn(s) to be used is or are particularly preferably produced in an integrated process step which immediately precedes jet texturing and in which the feed yarn for the core component is obtained by drawing a partially oriented yarn material and an immediately subsequent, essentially shrinkage-free heat treatment. Essentially shrinkage-free means that, during the heat treatment, the yarn is preferably held at a constant length, but that shrinkage of up to 4%, in particular up to 2%, can be allowed.

It has been found that the strength of the loop yarns obtained is about 5 to 20% higher when the drawing of the feed yarns for the core component is carried out as an integrated operation. It is assumed that the freshly drawn individual filaments are still flexible and can thus be intermingled particularly readily, i.e. with minimal loss of strength.

In this preferred embodiment of the process of the invention, therefore, the feed yarn for the core component, comprising a partially oriented yarn material is drawn, on a drawing unit, subjected to the essentially shrinkage-free heat treatment and immediately thereafter fed into the jet texturing stage. The drawing of the partially oriented yarn is carried out at a temperature of from 70° to 100° C., preferably on heated godets, at a drawing tension within the range from 10 to 30 cN/tex, preferably from 12 to 17 cN/tex (in each case based on the drawn linear density).

In this embodiment of the process of the invention, therefore, only the feed yarn intended as the core is obtained from a partially oriented yarn material, which is drawn on a drawing unit, subjected to an essentially shrinkage-free heat treatment and immediately thereafter fed into the jet texturing stage.

The essentially shrinkage-free heat treatment of the yarn following immediately on the drawing thereof is carried out for example at a temperature within the range from 180° to 250° C., preferably from 225° to 235° C.

This heat treatment can in principle be carried out in any known manner, but it is particularly advantageous to carry out the heat treatment directly on a heated takeoff godet.

After leaving the texturing jet, the primary two-component loop yarn is withdrawn under tension, so that, through reduction in the loop size, the primary yarn becomes mechanically stabilized. The withdrawal tension is usually from 0.05 to 1.0 cN/tex, preferably from 0.15 to 0.4 cN/tex. The tension is preferably chosen such that the loops formed remain essentially intact, i.e. are not closed up in the manner of a flower bud to any significant extent, if at all.

Thereafter the stabilized primary yarn is heated to set the yarn structure. It is advantageous to subject the yarn to a hot air treatment at air temperatures of from 200° to 320° C., preferably from 240° to 300° C., at constant length.

The setting is preferably carried out in a way which permits gentle and ideally uniform heating of the yarn. The setting process comprises the measures of:

j) preheating a heat transfer gas to a temperature which is above the desired yarn temperature, and k) feeding the preheated heat transfer gas into a yarn duct so that it flows into the yarn duct essentially perpendicularly to the yarn moving within the yarn duct and along such a length that the yarn heats up to the desired elevated temperature within the heating apparatus, the length of the zone of impingement of the gas on the yarn being such that, as a result of continuous removal of the boundary layer by the impinging heat transfer gas, the yarn comes into direct contact with the heat transfer gas and thus heats up very rapidly.

In this preferred setting process, the yarn is impinged on by the uniformly heated heat transfer gas over a certain length, so that the heat transport process is due more to the movement of the heat transfer gas (convection) than to heat transmission by temperature gradient. This form of impingement strips the yarn of its thermally insulating boundary layer of air over a considerable length and makes it possible for the hot heat transfer gas to release its heat to the yarn rapidly and uniformly. For this the temperature of the heat transfer gas need be only a little above the yarn temperature, since the bulk of the heat is transferred by convective air movement and only a relatively small proportion by temperature gradient. This convective form of heat transmission is very efficient and, what is more, overheating of the yarn material is avoided, making gentle and uniform heating a reality.

The heat transfer gas can be preheated in any conventional manner, for example by contact with a heat exchanger, by passing through heated tubes or by direct heating by heating spirals. The temperature of the preheated heat transfer gas is above the particular yarn temperature desired; preferably the heat transfer gas is heated to temperatures up to 20° C. thereabove and care is taken to ensure that no significant temperature drop occurs between the preheating and the actual heating of the yarn.

The hot heat transfer gas can be introduced into the yarn duct at any desired point. It is preferably introduced into the yarn duct in such a way that it can come into contact with the yarn along the entire yarn duct.

The heat transfer gas is preferably introduced into the yarn duct perpendicularly to the yarn transport direction, the heat transfer gas on the one hand being carried along by the moving yarn and leaving the heating apparatus together with the moving yarn via the yarn outlet and, on the other, moving in the direction opposite to the yarn transport direction and leaving the heating apparatus via the yarn inlet.

In a preferred embodiment, the heat transfer gas is blown perpendicularly onto the yarn from small orifices in the middle portion of the yarn duct over a length of about ¼ to ½ of the duct length and escapes from the yarn duct in the yarn transport direction and in the opposite direction. In a similarly preferred modification of this embodiment, the gas is blown in transversely and sucked away on the opposite side.

The contacting in the heating apparatus of the moving yarn with the heat transfer gas shall take place under such conditions that the yarn heats up to the desired elevated temperature within the heating apparatus and the heat transfer gas cools down in practice only very little in the heating apparatus.

The person skilled in the art has a number of measures at his disposal for achieving these requirements. For instance, it is possible to have the heat transfer gas flow through the yarn duct at a relatively high weight per unit time, relative to the yarn weight moving through the yarn duct per unit time, so that, notwithstanding the effective and rapid transmission of heat to the yarn, the heat transfer gas cools down only slightly. In contrast to impingement on the moving yarn at virtually one spot, impingement along a certain zone ensures a particularly intensive interaction of the heating gas with the yarn, since the boundary layer between the yarn and the surrounding medium is continuously stripped away in this zone. In this way it is possible to achieve effective heating of the yarn using only a small change in the temperature of the gas. Furthermore, the temperature course of the heat transfer gas can be controlled in the conventional manner by choice of the thermal capacity of the gas or its flow velocity.

The conventional setting processes for yarns having protruding filament ends or loops employ hot plates, hot rails or heated godets, which are heated to a temperature appreciably higher than the setting temperature in order to achieve sufficiently rapid heat transmission. This procedure is limited by the fact that protruding filament ends or loops in direct contact with the heater will melt, since they attain the high temperature of the heating element much more rapidly than the compact yarn, which heats up very much more slowly on account of its larger weight. The melting of the filament ends or loops results in sticky areas or deposits on the heater surface, which impair the running of the yarn. Moreover, the relatively severe shrinkage and melt effect reduces the number of loops per unit length. Incipiently melted filaments become brittle, which can lead to severe abrasion in the course of further processing, for example in the course of sewing. Setting the compact yarn at relatively high speeds while preserving the number of loops per unit length is also difficult to achieve with these methods. Even a contactless heat treatment of the yarn, for example in a heating tube, requires appreciable overheating of the walls in order that the desired setting temperature in the compact yarn may be obtained as a result of adequate heat transmission. This gives rise to essentially the same effects and disadvantages as described above for contact heating.

It has now been found that these difficulties can be appreciably reduced by allowing a hot gas to flow onto the moving yarn by forced convection. This ensures a sufficiently rapid supply of heat to the yarn in order that the desired setting temperatures may be achieved in the compact yarn. It is a particularly great advantage that the hot gas need only be heated to a little above the setting temperature, since the transmission of heat is not solely dependent on the temperature gradient, but is essentially determined by the flow of hot gas. The minimal overheating of the hot gas prevents premature melting of the protruding filament ends or loops, so that the setting temperature is achieved in the compact yarn without any excessively adverse effect on the heat-sensitive filament ends or loops. The upper limit for the temperature of the hot gas shall be the melting point of the protruding filament ends or loops. In the case of yarns based on polyethylene terephthalate, this upper limit is about 270° C.

The two-component loop yarns of the present invention have the advantages of the conventional two-component loop yarns. For instance, the loops of the individual filaments remain completely intact outside the texturing jet and, by virtue of the entrained air, produce good sewing properties even at high sewing speeds. This advantage is seen in high values for the sewing length to rupture, determined by the method known from DE-A-3,431,832. Furthermore, the two-component loop yarns of the invention give uniform dyeing along the length of the yarn, in particular the variants with filaments of fine linear density.

It is a particular advantage that the two-component loop yarn of the invention does not have to be twisted. It can be used for example as sewing yarn.

But, for example for reasons of eye appeal, it is also possible to apply a desired twist to the yarn, for example a twist of about 100 to 300 turns per meter (tpm), in the course of further processing.

The two-component loop yarns of the invention can be used for example as embroidery yarns or in particular as sewing yarns. These uses also form part of the subject-matter of the invention.

The Examples which follow illustrate the invention without limiting it. An apparatus for producing the two-component loop yarn of the invention may have for example the following elements: a creel for the bobbins of core and effect feed yarn, a drawing unit with heatable entry and exit godets for the production fo the core feed, whose speed can be set separately, a texturing jet yarn, a take-off roller for the defined withdrawal of the jet-textured yarn, if desired a customary hot air setting means as described above, and a take-up bobbin.

EXAMPLE 1

The creel is mounted with a bobbin of 490 dtex 32 filament POY as starting material for the production of the core feed yarn and a bobbin of 76 dtex 128 filament effect feed yarn. Both the feed yarns were made of polyethylene terephthalate having an intrinsic viscosity of 0.74 dl/g (feed yarn for the core component) or 0.63 dl/g (feed yarn for the effect component) (measured as defined above).

The effect feed yarn is an FOY having the following properties:

breaking extension of 35% shrinkage at 200° C. of 10%

The effect feed yarn was fed to the texturing jet directly via a pair of godets, the entry and the exit godet turning at virtually the same speed. The starting material for producing the core feed yarn was fed into a drawing unit and drawn there by means of godets in a ratio of 1:3.25. The temperatures of the entry godets were 85° C. and of the exit godets 232° C. The drawn yarn was guided around the heated exit godet of the drawing unit. The filament linear density of the feed yarns before entry into the texturing jet was 4.71 dtex for the core yarn and 0.57 dtex for the effect yarn. The jet-textured yarn was withdrawn from the texturing jet in such a way as to produce an overfeed of 7% for the core yarn and 18% for the effect yarn.

After leaving the texturing jet the loop yarn was mechanically stabilized by withdrawal at a yarn tension of 0.46 cN/tex. The yarn was then set by passing it through a 260° C. hot air oven.

The raw yarn thus obtained was wound up and then dyed.

Prior to dyeing, the raw yarn data were as follows:

Final linear density: 249.4 dtex

Final tenacity: 48.2 cN/tex

Heat shrinkage at 200° C.; 6.4%

Breaking extension 12.8%

The raw yarn obtained was uniformly dyeable.

EXAMPLE 2

Example 1 was repeated with a 256 dtex 48 filament POY as starting material for the production of the core feed yarn and a bobbin of 50 dtex 32 filament effect feed yarn. Both the feed yarns were made of polyethylene terephthalate having an intrinsic viscosity of 0.73 dl/g (feed yarn for the core component) or 0.63 dl/g (feed yarn for the effect component) (measured as defined above).

The effect feed yarn is an FOY having the following properties:

breaking extension of 43% shrinkage at 200° C. of 8.8%

The effect feed yarn was fed to the texturing jet directly via a pair of godets, the entry and the exit godet turning at virtually the same speed (the speed difference between the entry and exit godets is, for example, up to 5%). The starting material for producing the core feed yarn was fed into a drawing unit and drawn there by means of godets in a ratio of 1:2.20. The temperatures of the entry godets were 85° C. and of the exit godets 232° C. The drawn yarn was guided around the heated exit godet of the drawing unit. The filament linear density of the feed yarns before entry into the texturing jet was 2.42 dtex for the core yarn and 1.49 dtex for the effect yarn. The jet-textured yarn was withdrawn from the texturing jet in such a way as to produce an overfeed of 7% for the core yarn and 17% for the effect yarn.

After leaving the texturing jet the loop yarn was mechanically stabilized. The yarn was then set by passing it through a 260° C. hot air oven.

The raw yarn thus obtained was wound up and then dyed.

Prior to dyeing, the raw yarn data were as follows:

Final linear density: 183.6 dtex

Final tenacity: 46.1 cN/tex

Heat shrinkage at 200° C.: 4.0%

Breaking extension 15.4%

The raw yarn obtained was uniformly dyeable.

What is claimed is:

1. A two-component loop yarn comprising a core of POY intermingled with effect yarn which is FOY, both made of synthetic polymers, and wherein:

i) at least some of the effect yarn is made of polyester, ii) at least some of the effect yarn has a breaking extension of from 35 to 70%, iii) at least some of the effect yarn has a birefringence of from $100=10^{-3}$ to 150*10–3, iv) at least some of the effect yarn has a hot air shrinkage at 200° C. of from 3 to 14%, and v) the effect yarn has a filament linear density of not greater than 1.5 dtex, and wherein at first some of the effect yarn is obtainable by a process comprising the steps of;

vi) melt spinning multifilaments in a conventional spinning apparatus that includes spinning jets and a take-off element with a heating element between the spinning jets and the take-off element, vii) cooling the spun multifilaments upstream of the heating element to a solidification temperature or below, and viii) subsequently heating the multifilaments to temperatures above the solidification temperature under the simultaneous action of a thread tension resulting from friction against a surrounding gaseous medium, which thread tension is subsequently equal to drawing tension.

2. The two-component loop yarn of claim 1 wherein the proportion of effect yarns is at least 25% by weight, based on the two-component loop yarn.

3. The two-component loop yarn of either of claim 1 wherein the core yarn has a filament linear density of not greater than 2 dtex.

4. The two-component loop yarn of claim 1 having a final linear density of from 100 to 1000 dtex.

5. The two-component loop yarn of claim 1 comprising core yarn having a tenacity of from about 30 to about 80 cN/tex.

6. The two-component loop yarn of claim 1 having a final tenacity of more than 30 cN/tex.

7. The two-component loop yarn of claim 1 having a hot air shrinkage at 200° C. of below 8%.

8. The two-component loop yarn of claim 1 wherein the core and effect yarns are made of polyethylene terephthalate.

9. The two-component loop yarn of claim 1 wherein the core yarn is made of a polyester which has an intrinsic viscosity (measured in solutions in dichloroacetic acid at 25° C.) of greater than 0.65 dl/g.

10. The two-component loop yarn of claim 1 wherein the core and effect yarns are made of a low-flammability polyester.

* * * * *

UNITED STATES PATENT AND TRADEMARK OFFICE

CERTIFICATE OF CORRECTION

PATENT NO. : 5,593,777
DATED : January 14, 1997
INVENTOR(S) : Ingolf Jacob, et. al.

It is certified that error appears in the above-indentified patent and that said Letters Patent is hereby corrected as shown below:

Column 2, line 24, "pathy" should read -- path --; and line 26, "or" should read -- of --.

Column 3, line 55, "polyarnides" should read -- polyamides --.

Column 4, line 49, "mote" should read -- more --.

Column 5, line 6, after "least" insert -- 25% -- ; line 15, after "jet" insert -- at -- and after line 35 (in the formula), change " (1(V " to -- (1 + (V -- (both occurrences).

Column 9, line 53, "fo" should read -- of --.

Column 11, line 11 (claim 1, line 8) "100=10" should read -- 100 * 10 --; and line 17 (claim 1, line 13) "first" should read -- least --.

Column 12, line 7 (claim 3, line 1), delete "either of";

Signed and Sealed this

First Day of July, 1997

Bruce Lehman

*Attest:*

BRUCE LEHMAN

*Attesting Officer*

*Commissioner of Patents and Trademarks*